US009809053B2

(12) United States Patent
Alfter

(10) Patent No.: US 9,809,053 B2
(45) Date of Patent: Nov. 7, 2017

(54) FLUID APPLICATOR

(71) Applicant: Kenneth C. Alfter, Hartford, WI (US)

(72) Inventor: Kenneth C. Alfter, Hartford, WI (US)

( * ) Notice: Subject to any disclaimer, the term of this patent is extended or adjusted under 35 U.S.C. 154(b) by 0 days.

(21) Appl. No.: 15/132,353

(22) Filed: Apr. 19, 2016

(65) Prior Publication Data

US 2016/0228908 A1 Aug. 11, 2016

Related U.S. Application Data

(63) Continuation-in-part of application No. 14/036,923, filed on Sep. 25, 2013, now Pat. No. 9,314,094.

(60) Provisional application No. 61/851,711, filed on Mar. 13, 2013.

(51) Int. Cl.

| | |
|---|---|
| ***B05C 17/12*** | (2006.01) |
| ***B43M 11/06*** | (2006.01) |
| ***A46B 5/00*** | (2006.01) |

(52) U.S. Cl.

CPC ..... *B43M 11/06* (2013.01); *A46B 5/00* (2013.01); *A46B 2200/202* (2013.01); *B05C 17/12* (2013.01)

(58) Field of Classification Search

CPC ..... B05C 17/12; B05C 1/00; A46B 2200/202; A46B 5/00

See application file for complete search history.

(56) References Cited

U.S. PATENT DOCUMENTS

| | | | |
|---|---|---|---|
| 1,999,642 | A | 4/1935 | Shepherd |
| 6,131,740 | A | 10/2000 | Huang |
| 6,390,968 | B1 | 5/2002 | Harmon |
| D467,613 | S | 12/2002 | Indegno et al. |
| 6,547,467 | B2 | 4/2003 | Quintero |
| D501,512 | S | 2/2005 | Shova et al. |
| D554,183 | S | 10/2007 | Paulus et al. |
| D557,340 | S | 12/2007 | Nagahama et al. |
| D584,774 | S | 1/2009 | Morimura et al. |
| D630,249 | S | 1/2011 | Nabetani et al. |
| 7,866,327 | B1 | 1/2011 | Gueret |
| D648,798 | S | 11/2011 | Shimizu |
| D712,961 | S | 9/2014 | Jurcevic |
| D714,866 | S | 10/2014 | Heipp et al. |

OTHER PUBLICATIONS

U.S. Office Action dated Oct. 22, 2014 regarding U.S. Appl. No. 14/036,923 13 pages.

U.S. Office Action dated May 27, 2015 regarding U.S. Appl. No. 14/036,923 13 pages.

U.S. Office Action dated Dec. 2, 2015 regarding U.S. Appl. No. 14/036,923 13 pages.

*Primary Examiner* — Xiao Zhao

(74) *Attorney, Agent, or Firm* — Smith Keane LLP

(57) ABSTRACT

Systems and methods directed to the art of transferring a fluid, such as to a work surface, are provided. A fluid applicator capable of being received within a standard hobby knife handle and used to apply a desired amount of fluid to a work surface. The fluid applicator has a loop end for collecting, supporting, and depositing a fluid.

9 Claims, 7 Drawing Sheets

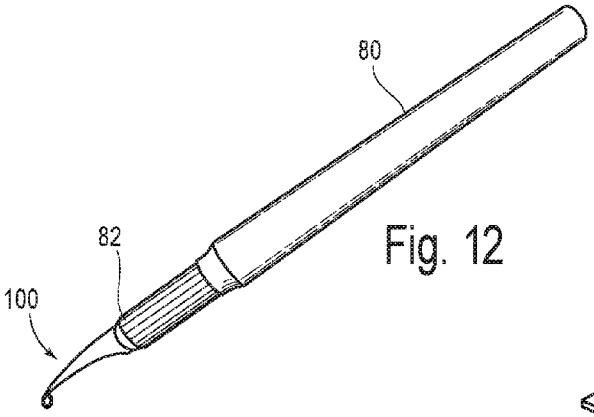
Fig. 12
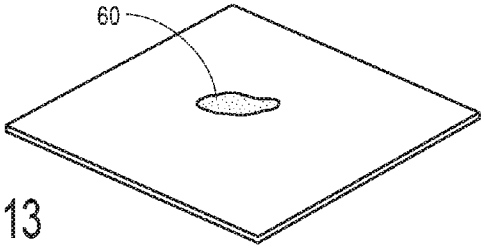
Fig. 13
Fig. 14
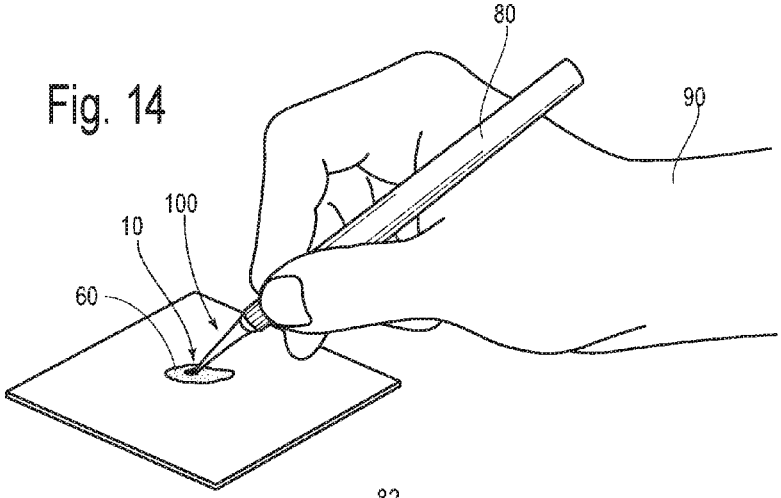
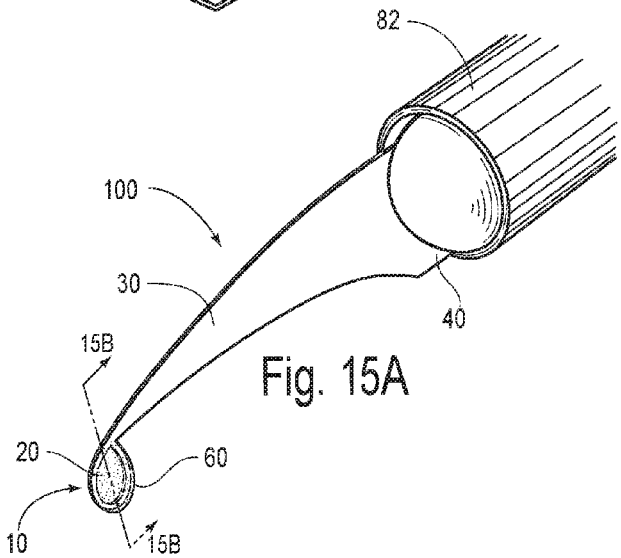
Fig. 15A
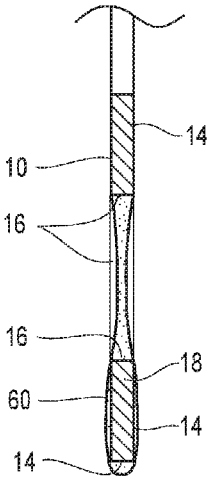
Fig. 15B

FLUID APPLICATOR

RELATED APPLICATIONS

This application is a continuation-in-part of co-pending U.S. patent application Ser. No. 14/036,923, filed 25 Sep. 2013, and entitled "Fluid Applicator," which claims the benefit of U.S. Provisional Patent Application Ser. No. 61/851,711, filed 13 Mar. 2013, and entitled "Glue Looper," both of which are incorporated by reference herein in their entireties.

BACKGROUND OF THE INVENTION

Application of a controlled amount of fluid to a work surface is a fairly precision driven endeavor. For example, in the world of model building, proper application of glue, in both amount and location, to work pieces may be the difference between a clean and properly adhered work piece and a sloppy mess. Other areas in which fluid may be applied in a precise manner include, localized cleaning, targeted lubrication, laboratory/scientific testing, surgical procedures, etc.

Prior tools used to apply fluid to a model have included glass rods, fine paintbrushes, and even small aluminum tubes. However, these prior devices lack in the ability to apply a precise and controlled amount of glue, or other fluid, to a work piece consistently. Accordingly, the art of fluid applicators could benefit from a device capable of supplying a precise and controlled amount of glue, or other fluid, to one or more work surfaces.

SUMMARY OF THE INVENTION

The present invention relates to a fluid applicator, and more particularly to a fluid applicator capable of precisely and accurately applying fluid to one or more work surfaces.

One aspect of the invention provides a fluid applicator with a neck having a first neck end extending in a neck direction to a second neck end and a neck thickness disposed perpendicular to the neck direction, and a loop adjoined to the first neck end having a rim defining an aperture, and the rim having a rim thickness parallel to the neck thickness. The loop and neck are preferably contiguously formed from the same sheet of material.

The aperture and/or rim of the fluid applicator may be obovate in shape.

The fluid applicator may also have a length and a base adjoining the second neck end, wherein the base has a first base side, a second base side formed contiguous with the first base side, a third base side formed contiguous with the second base side, and a thickness.

The fluid applicator may also have a length axis collinear with the base first side, wherein the loop aperture has a major axis comprising a first point located along the loop aperture perimeter nearest the first neck end and a second point located at a point along the loop aperture perimeter furthest from the first point, and wherein the major axis is oriented approximately 45 degrees from the length axis.

The rim of the fluid applicator may also have a quadrilateral cross-section.

The rim of the fluid applicator may also have a gap approximately diametrically opposed from the first point.

The rim thickness of the fluid applicator may also be 0.003 inch to 0.01 inch.

The rim thickness of the fluid applicator may also be 0.005 inch.

The base thickness of the fluid applicator may also be greater than the neck thickness and greater than the rim thickness.

The base thickness of the fluid applicator may also be greater than the rim thickness and the neck thickness may also be greater than the rim thickness.

An embodiment of a fluid applicator according to the present invention may include a neck having a first neck end extending in a neck direction to a second neck end, and a neck thickness disposed perpendicular to the neck direction. A pair of tines disposed at and extend from the first neck end, each tine extending from the first neck end to a tine free end. Each tine may have a tine thickness parallel with and at least substantially equal to the neck thickness. The neck and tines may be contiguously formed from a single sheet of material. A contiguous base may extend from the second end of the neck.

The tines may be separated from each other along a majority of their length by a tine gap. The tine gap may extend along an axis that is disposed at about a 45 degree angle to the general direction of the length of the fluid applicator. Each tine may have the same or similar cross-sections along a majority of their length, such as quadrilateral cross-sections. Different tine thicknesses may be provided for particular uses.

BRIEF DESCRIPTION OF THE DRAWINGS

FIG. 12 is a perspective view of the first embodiment fluid applicator fit within a handle.

FIG. 13 is a perspective view of a fluid on a surface.

FIG. 14 is a perspective view of the first embodiment fluid applicator being dipped in the fluid of FIG. 13.

FIG. 15A is a perspective view of the fluid supported on the loop of the first embodiment applicator.

FIG. 15B is a cross-sectional view along line 15B-15B of FIG. 15A.

DESCRIPTION OF THE PREFERRED EMBODIMENT

Figure 1:
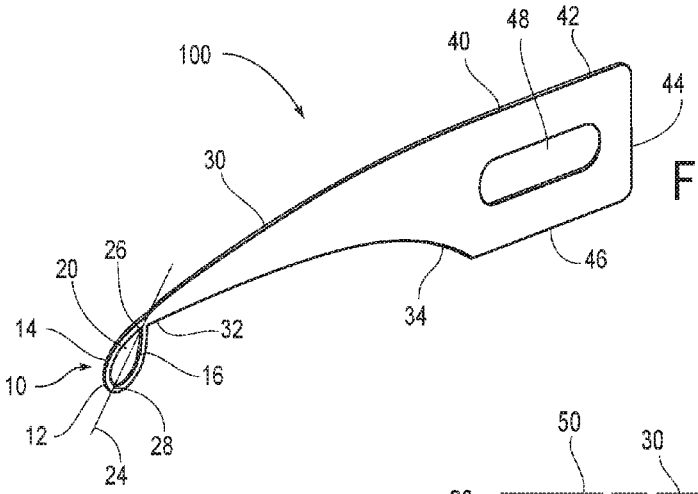
FIG. 1 is a perspective view of a first embodiment of a fluid applicator according to the present invention.

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

A first embodiment 100 of a fluid applicator according to the present invention is illustrated in FIGS. 1-4. The applicator 100 comprises a loop 10, a neck 30, and a base 40 along a length axis 50.

The loop 10 comprises a rim 12 and an aperture 20. The rim 12 has an exterior surface 14 extending around the periphery and sides of the loop 10 and an interior surface 16 which defines the shape of the aperture 20. As shown in FIG. 2B, the rim 12 preferably has a quadrilateral cross-section having a thickness T, and a width W. In the embodiment shown, the thickness T is approximately 0.005 inches. The loop 10 may be comprised of metal or non-metal, including but not limited to, brass, stainless steel, or plastic, as certain material characteristics may be favorable in different environments.

The neck 30 has a first end 32 and a second end 34. The first end 32 is contiguous with the loop 10. As illustrated in the Figures, the neck 30 preferably has a tapered shape, with the narrowest portion located at the first end 32 and gradually increasing in width towards the second end 34. Moreover, the first end 32 of the neck 30 may be narrower than the width W of the loop 10. Similar to the loop 10, the neck 30 may be comprised of metal or non-metal, including but not limited to, brass, stainless steel, or plastic.

The base 40 is contiguous with the second end 34 of the neck 30. It has a first side 42 substantially parallel with the length axis 50, a second side 44 perpendicular to the first side 42, and a third side 46 substantially perpendicular with the second side 44 and substantially parallel with the first side 42. The base 40 may also have an opening 48. The opening 48 may be configured to receive a key (not shown) located in a tightening mechanism 82 of a standard hobby knife handle 80 (see FIG. 13), such as described in U.S. Pat. No. 2,465,433 directed to a Tool, incorporated herein by reference. Similar to the loop 10 and neck 30, the base 40 may be comprised of metal or non-metal, including but not limited to, brass, stainless steel, or plastic.

Figure 2A:
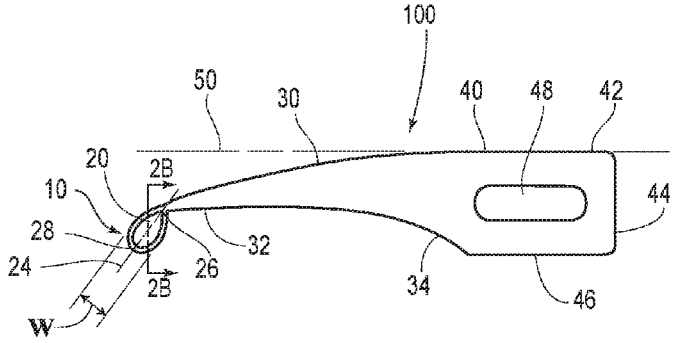
FIG. 2A is a side view of the fluid applicator of FIG. 1.
Figure 2B:
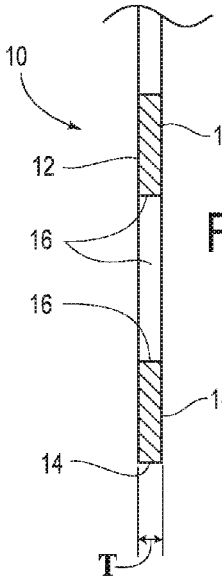
FIG. 2B is a cross-sectional view of the fluid applicator along line 2B-2B of FIG. 2A.
Figure 4:
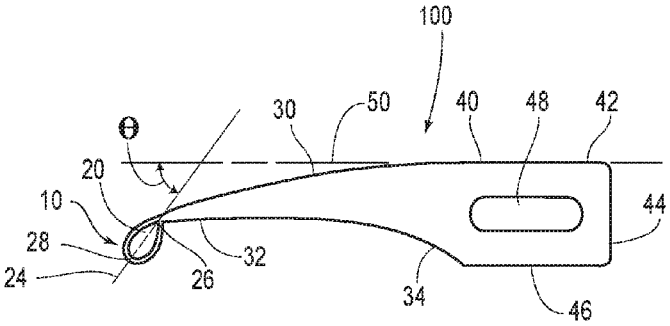
FIG. 4 is another side view of the fluid applicator of FIG. 1.

Still with reference to FIGS. 1 and 2A, and with further reference to FIG. 4, the rim 12 is obovate. Meaning that it is mostly egg-shaped and narrow where it joins the first end 32 of the neck 30; however, other shapes are contemplated. Moreover, it can be seen that the aperture 20 is also obovate; however, similar to the rim 12, the aperture 20 may take any shape. Alternatively, the rim 12 and aperture 20 may comprise different shapes and may even be shaped differently from each other.

Additionally, the loop aperture 20 has a major axis 24 extending between a first point 26 and a second point 28. The first point 26 is located on the interior surface 16 at the spot nearest to the first end 32 of the neck 30. The second point 28 is located on the interior surface 16 furthest from the first point 26. Moreover, the major axis 24, as illustrated in the embodiment shown here, is oriented at an angle θ. In this embodiment 100, the angle θ is approximately 45 degrees from the length axis 50.

Figure 3:
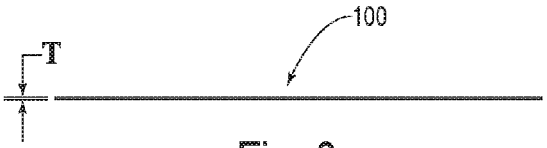
FIG. 3 is a top view of the fluid applicator of FIG. 1.

As illustrated in FIGS. 1-3, the fluid applicator 100 may be plate-like; comprised of one continuous piece (e.g., sheet) of material with a unitary thickness T perpendicular to the length axis. Furthermore, the applicator 100 may be formed by any means known now or in the future to produce the applicator 100 as disclosed herein. As non-limiting examples, if the applicator 100 comprises metal, the applicator 100 may be formed by, e.g. photo-etching, or, if the applicator 100 comprises plastic, the applicator 100 may be formed by, e.g., injection molding. Photo-etching may be advantageous because it eliminates the potential for burrs, as are common in metal machining. Photo-etching also permits precise replication of the applicator 100 because there are no cutting tools used, which may dull, and no dies, which may distort or wear out.

Figure 5A:
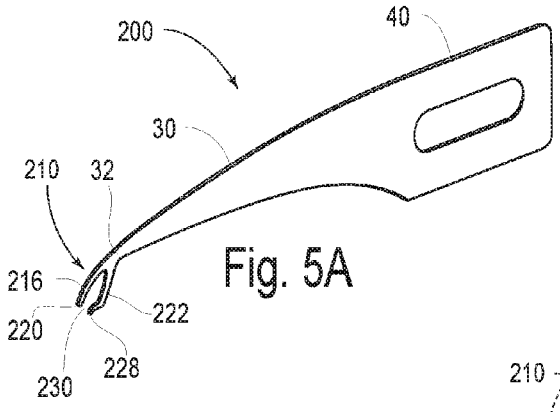
FIG. 5A is a perspective view of a second embodiment of a fluid applicator according to the present invention.
Figure 5B:
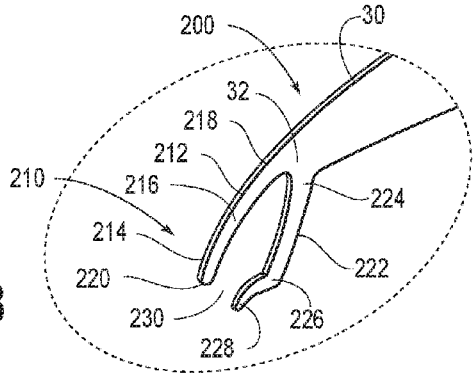
FIG. 5B is an enhanced perspective view of the second embodiment shown in FIG. 5A.

Looking now to FIGS. 5A and 5B in which a second embodiment 200 of the fluid applicator is shown. The fluid applicator 200 has a neck 30 and a base 40 similar to the applicator 100 but also comprises an open-loop 210 including a rim 212 having a discontinuous exterior surface 214 and comprising a first member or tine 216 and a second member or tine 222 opposite the first member 216. In this embodiment 200, the first member 216 and the second member 222 are asymmetric. The first member 216 has a proximal end 218 located at the first end 32 of the neck 30 and a distal end 220. The first member 216 extends outwardly arcuately from the proximal end 218 to the distal end 220. The second member 222 has a proximal end 224 located at the first end 32 of the neck 30, a medial portion 226, and a distal end 228. The second member 222 extends from the proximal end 224 outwardly arcuately to the medial portion 226. The second member 222 continues from the medial portion 226 to the distal end 228 inwardly arcuately. A tine gap 230 is formed between the first tine 216 and second tine 222, and the gap 230 may be narrowest between the first tine distal end 220 and the second tine distal end 228.

Figure 6A:
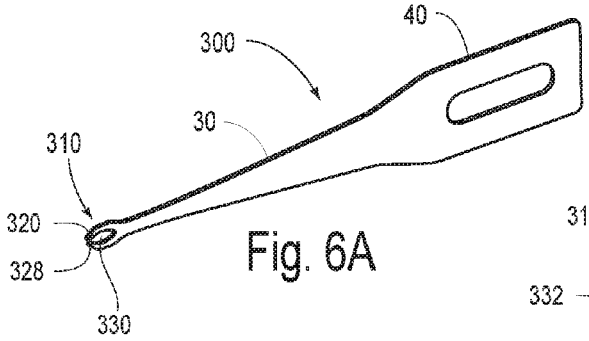
FIG. 6A is a perspective view of a third embodiment of a fluid applicator according to the present invention.
Figure 6B:
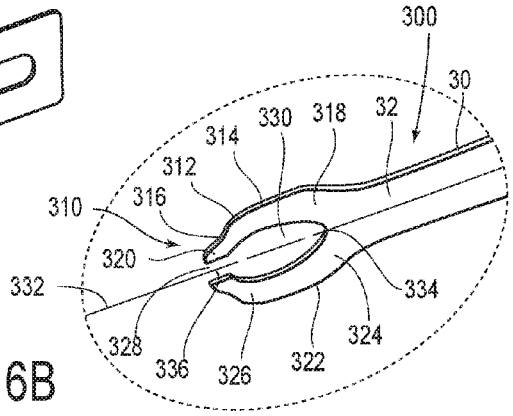
FIG. 6B is an enhanced perspective view of the third embodiment shown in FIG. 6A.

A third embodiment 300 of the fluid applicator is shown in FIGS. 6A and 6B. The fluid applicator 300 has an open-loop 310 defining a rim 312 having a discontinuous exterior surface 314 and comprises a first member or tine 316 and a second member or tine 322 opposite the first member 316. In this embodiment 300, the first member 316 and the second member 322 are preferably symmetric. The first member 316 has a proximal end 318 located at the first end 32 of the neck 30 and a distal end 320. The first member 316 extends outwardly arcuately from the proximal end 318 to the distal end 320. The second member 322 also has a proximal end 324 located at the first end 32 of the neck 30 and a distal end 326. The second member 322 extends outwardly arcuately from the proximal end 324 to the distal end 326. A tine gap 328 is formed between the first tine 316 and second tine 322, and the gap 230 may be narrowest between the first tine distal end 320 and the second tine distal end 326.

Still looking at FIGS. 6A and 6B, the fluid applicator 300 defines an aperture 330. The aperture 330 has a major axis 332 extending between a first point 334 and a second point 336. The first point 334 is located at the position of the aperture 330 nearest to the first end 32 of the neck 30. The second point 336 is located in the center of the gap 328. The major axis 332 in this embodiment is preferably parallel with the length axis 50, but may be disposed obliquely thereto.

Figure 7:
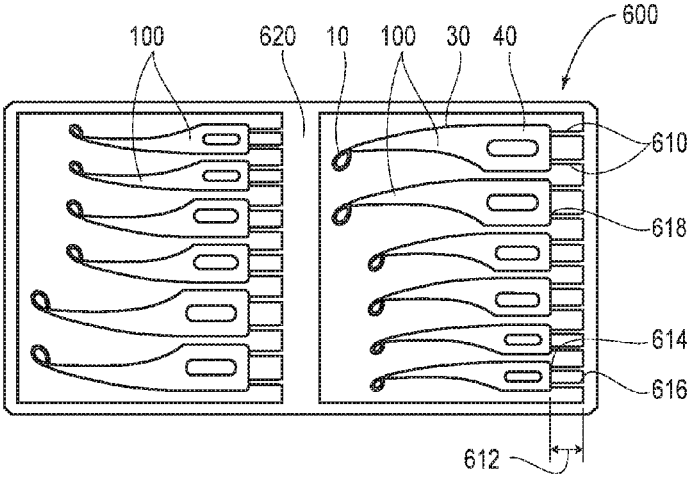
FIG. 7 is a top view of an embodiment of a fret tree comprising a plurality of fluid applicators according to the present invention.

Now looking to FIG. 7 which illustrates a plurality of applicators 100 of different sizes removably attached to a fret tree 600. The fret tree 600 comprises a frame 620 and at least one tab 610. As shown, each applicator 100 is attached to the fret tree frame 620 by two tabs 610. Each tab 610 has a length 612, a first end 614, and a second end 616. The first end 614 of the tab 610 is contiguous with the base 40 of the applicator 100, wherein a stress riser 618, such as a notch or hole, may be provided where the two meet. Furthermore, the second end 616 is contiguous with the fret tree frame 620. A stress riser 618 may also be provided at the junction of the second end 616 and the fret tree frame 620. The applicators 100 may be removed from the fret tree 600 at either the tab first end 614 or the tab second end 616 by fatiguing the respective connection point or stress riser 618 until connection failure and separation occurs. The applicators 100 and fret tree 600 may comprise the same material and may also be formed from one piece of material.

Figure 8:
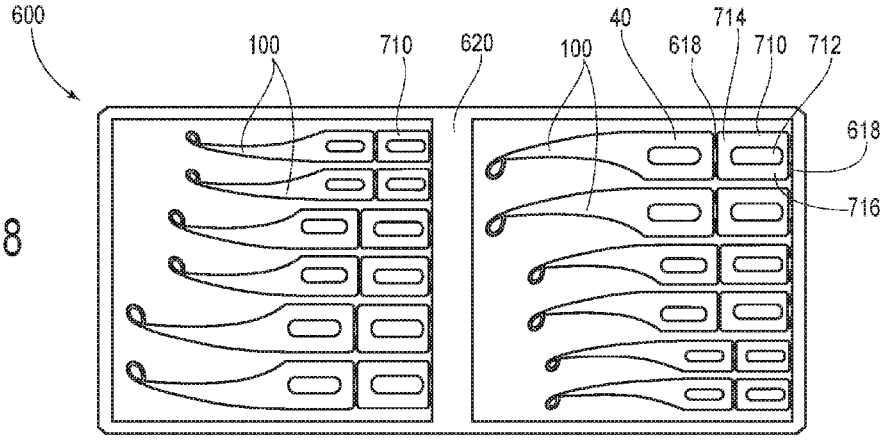
FIG. 8 is a side view of an alternative embodiment of a fret tree according to the present invention.

FIG. 8 shows an alternative embodiment 710 of a tab according to the present invention. The tab 710 has a first end 714 and a second end 716. At least one stress riser 618 is provided at the junction of the base 40 and the tab 710 at the tab first end 714 and at least one stress riser 618 is provided at the junction between the tab 710 and the fret tree frame 620 at the tab second end 716. The tab 710 preferably mirrors the shape and configuration of the base 40 about the at least one stress riser 610 at the base/tab-first-end junction. Furthermore, the applicators 100 may be removed from the fret tree frame 620 at the tab first end 714 or at the tab second end 716 by fatiguing the respective stress riser 618 until separation occurs.

Furthermore, it may be advantageous to have a base 40 that is thicker than thickness T. As shown in FIG. 12, the base 40 of the applicator 100 is installed within a handle 80. A thicker base 40 may be preferred in a situation in which the handle 80 is incapable of closing fully and therefore incapable of securing the applicator 100 properly.

Figure 9A:
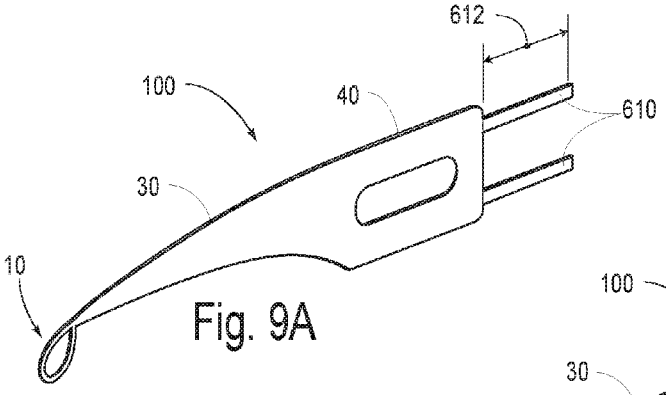
FIGS. 9A-9C depict a progressive method of effectively adding thickness to the base.
Figure 9B:
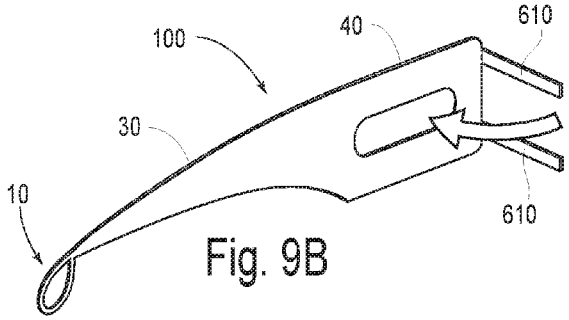
Figure 9C:
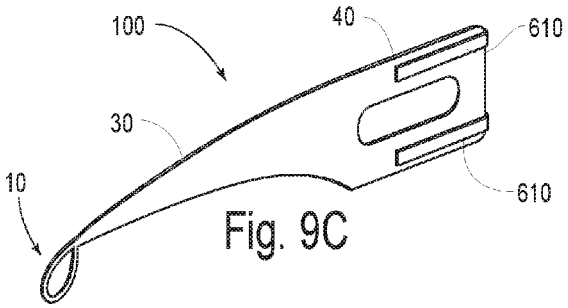

That being said, FIGS. 9A-9C illustrate how the tabs 610 may be used to effectively increase the thickness of the base 40. FIG. 9A shows the applicator 100 after it has been removed from the fret tree 600 of FIG. 7 with the tabs 610 still attached to the base 40. FIG. 9B illustrates the bending of each tab 610 about its first end 614, and FIG. 9C shows the tabs 610 positioned substantially parallel with the base 40 while preferably remaining attached thereto. The length 612 of the tabs 610 is preferably sufficient to effectively double the thickness of the base 40.

Figure 10A:
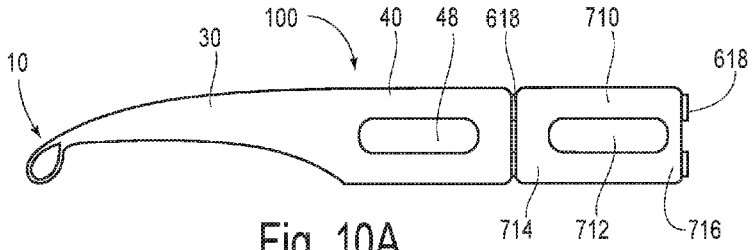
FIGS. 10A-10C depict a progressive method of effectively adding thickness to the base.
Figure 10B:
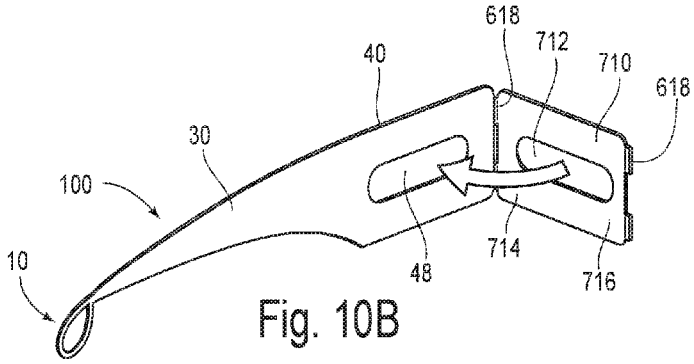
Figure 10C:
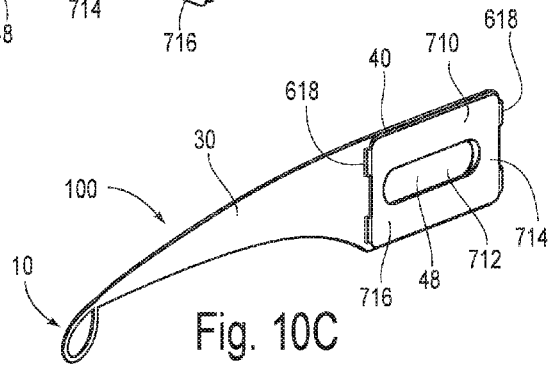

Additionally, FIGS. 10A-10C illustrate a similar capability of effectively adding thickness to the base 40 as described above by removing the applicator 100 from the fret tree frame 620 at the tab second end 716, bending the tab 710 about the at least one stress riser 618 at the tab first end 714 to be substantially parallel with the base 40 while preferably remaining attached thereto. Here, the tab 710 is depicted having an opening 712 that aligns with the base opening 48.

Figure 11A:
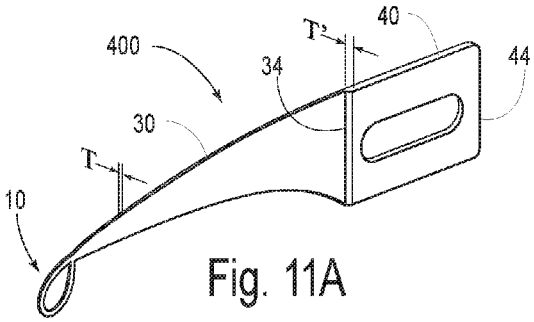
FIG. 11A is a perspective view of a fourth embodiment of a fluid applicator according to the present invention.
Figure 11B:
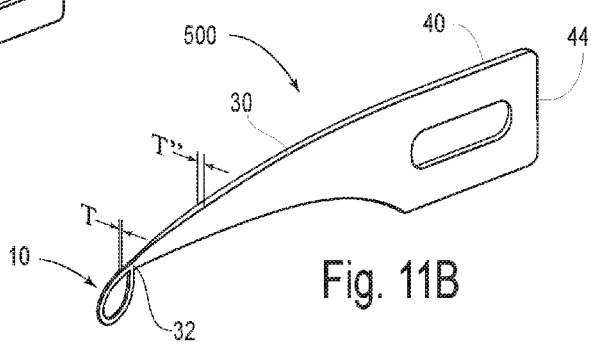
FIG. 11B is a perspective view of a fifth embodiment of a fluid applicator according to the present invention.

Moreover, FIGS. 11A and 11B illustrate alternative applicator embodiments 400, 500. Applicator 400, shown in FIG. 11A, has an increased base thickness T' extending from the second side 44 of the base 40 to the second end 34 of the neck 30. The neck 30 and the loop 10 retain the thickness T. FIG. 11B shows the applicator 500 having a thickness T" extending from the second side 44 of the base 40 to first end 32 of the neck 30, whereby the loop 10 retains the thickness T.

Now looking to FIGS. 12-20, the applicator 100 is shown in use and a method for use is described herein. The method comprises, providing an applicator 100 as disclosed herein installed within a handle 80. The method may also include the step of providing a fluid 60, or a fluid 60 may be previously provided. At least a portion of the loop 10 is dipped into the fluid 60, whereby the fluid 60 is at least partially suspended by the rim 12, and more preferably, the aperture 20, and applying the fluid 60 from the applicator 100 to a work surface 70. Application of the fluid 60 to the work surface 70 may be achieved by touching the fluid 60 suspended on the loop 10 to the work surface 70, thereby allowing it to transfer.

As discussed previously, smaller or larger, open or closed, applicators 100, 200, 300, 400, 500 may be selected and/or used depending on the viscosity of the fluid 60 and/or the amount of fluid 60 to be applied. For example, one type of fluid that could be used is cyanoacrylate adhesive ("CA"). CA is commonly used in model making and may have a viscosity as low as 5 centipoise (cP) to as high as 28,000 cP, and anywhere in between.

Furthermore, the loop design may provide an advantage in fluid application. The loop design provides an adequate amount of surface area, comprising the interior surface 16 and the exterior surface 14, to maintain surface tension between the loop 10 and the fluid 60 (see FIG. 15B) which allows the fluid 60 to be supported, but it also provides an aperture 20 to carry a sufficient amount of fluid 60 within the loop 10 that is not subject to surface tension and may promote more effective fluid transfer from the loop 10 to the work surface 70.

Figure 16:
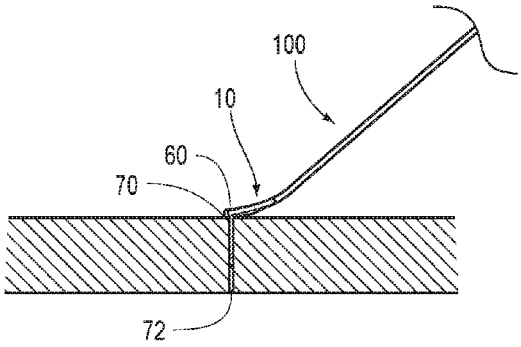
FIG. 16 is a side view of a fluid being applied with an applicator to an abutting joint.

FIGS. 16-19 illustrate the application of fluid 60 from the applicator 100 to different types of work surfaces 70. FIG. 16 shows the fluid 60 being applied to an abutment seam 72. Generally, a user 90 may be able to transfer the fluid 60 from the applicator 100 to the work surface 70 by touching a portion of the loop 10 to the work surface 70. The loop 10 may be flexed or deflected with respect to the neck 30 when touched to the work surface 70.

Figure 17:
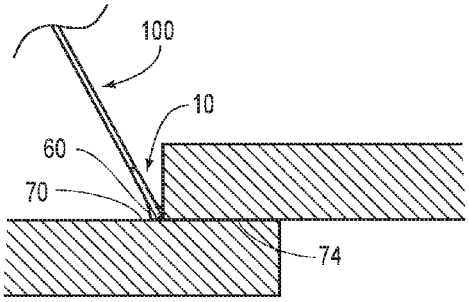
FIG. 17 is a side view of a fluid being applied with an applicator to an overlapping joint.
Figure 18:
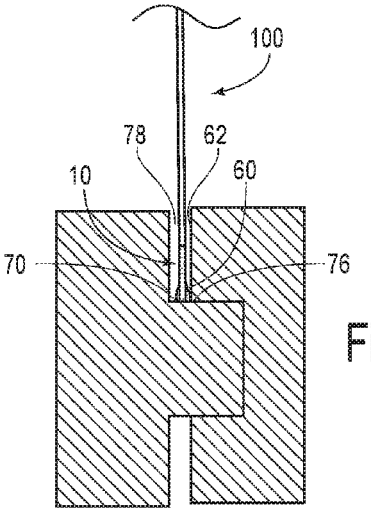
FIG. 18 is a side view of a fluid being applied with an applicator to a hidden joint.
Figure 19:
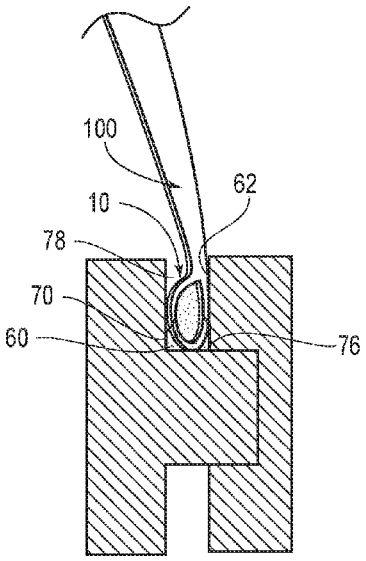
FIG. 19 is a side view of a fluid being applied with an applicator in a hidden joint.

Furthermore, FIG. 17 illustrates the application of fluid 60 from the applicator 100 to an overlap seam 74. FIG. 18 illustrates the capability of the applicator 100 to allow a user 90 to apply a controlled amount of fluid 60 to a hidden seam 76 with limited access while reducing the chance of transferring the fluid 60 to other internal surfaces 62 accidentally. However, if the intention is to fill a crevice 78 with fluid 60, a user 90 may position the applicator 100 so that it makes contact with the internal surfaces 62 of the crevice 78 for dispensation of the fluid 60 throughout, as shown in FIG. 19.

Figure 20:
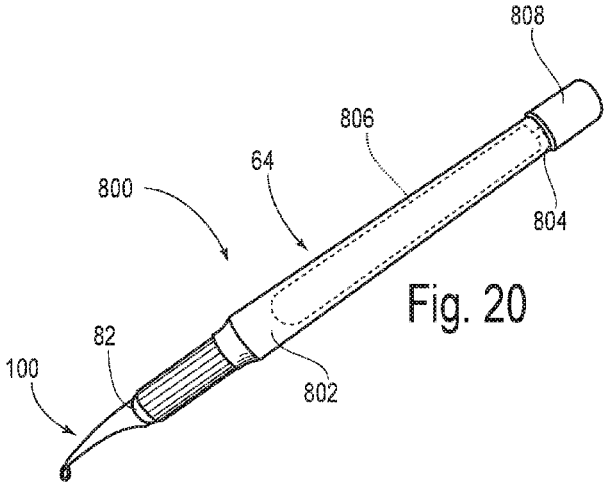
FIG. 20 depicts an alternative embodiment of a handle.

Moving on to FIG. 20 in which another embodiment for a hobby knife handle 800 is shown. The handle 800 has a first end 802 and a second end 804. A recess 806 extends from the second end 804 towards the first end 802. A cap 808 may be removably secured to the handle 800 by any means known in the art, including, but not limited to, snapping means, interfacing threads, or friction fit. Fluid 60 (not shown) may be contained in the recess 806 and accessed by removing the cap 808. The fluid 60 may be dispensed into the cap 808 prior to use of the applicator 10.

Figure 21A:
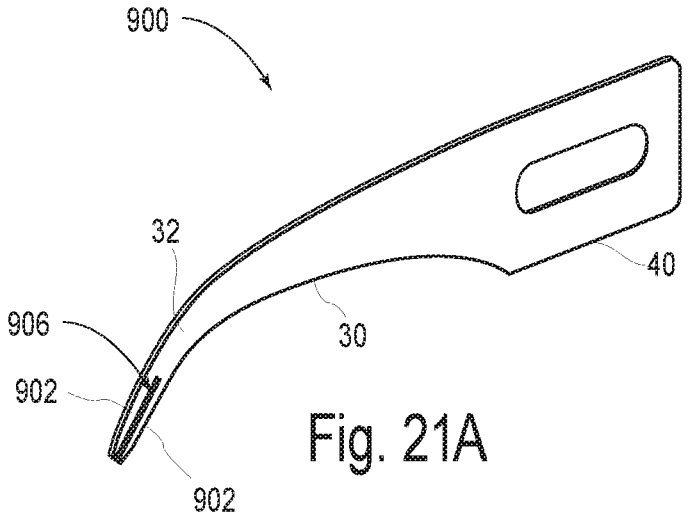
FIG. 21A is a perspective view of a sixth embodiment of a fluid applicator according to the present invention.
Figure 21B:
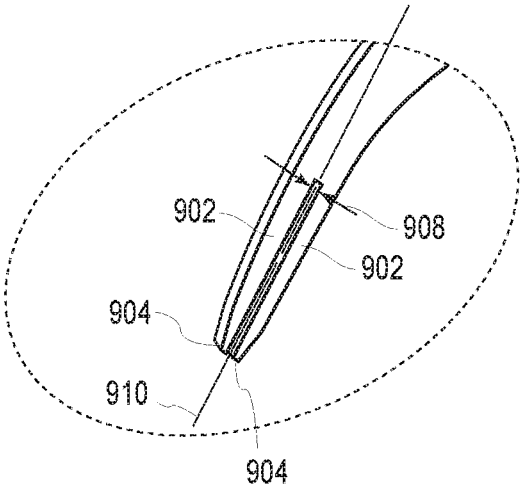
FIG. 21B is an enhanced perspective view of the sixth embodiment shown in FIG. 21A.

FIGS. 21A and 21B depict a sixth embodiment 900 of a fluid applicator according to the present invention. Like the embodiments of FIGS. 5A-B and 6A-B, this fluid applicator 900 includes a pair of tines 902 extending from the first neck end 32, each tine 902 terminating in a tine free end 904. The tines 902 are separated along a majority of their length by a tine gap 906, which may be substantially uniform in width 908, as shown. Alternatively, the tine gap 906 may have a varying width along the tine length as those shown with respect to FIGS. 5A-6B. The tine gap 906 generally extends along a tine gap axis 910 which extends through the first neck end 32 (e.g., a vertex at which the tines 902 intersect or join the first neck end 32) and a point disposed between and equidistant from each tine free end 904. Each tine 902 has a tine thickness, parallel to the neck thickness T, the tine thickness being less than, at least substantially equal to, or greater than the neck thickness T. A preferred tine thickness is between about 0.003 inches to about 0.010 inches, with about 0.005 inches being most preferred. Each tine 902 preferably has substantially the same cross-section along a majority of its length, and that cross-section is preferably quadrilateral. This embodiment 900 may include a base 40 and/or tab 610 (not shown here) as previously discussed in connection with the other embodiments herein.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A fluid applicator comprising:

a neck having a first neck end extending in a neck direction to a second neck end, and a neck thickness disposed perpendicular to the neck direction; and a pair of tines disposed at the first neck end, each tine extending from the first neck end to a tine free end, and each tine having a tine thickness parallel with and at least substantially equal to the neck thickness;

wherein the neck and tines are contiguously formed from a single sheet of material.

2. The fluid applicator of claim 1, wherein the tines are separated from each other along a majority of their length by a tine gap.

3. The fluid applicator of claim 1 having a length and further comprising:

a base adjoining the second neck end, the base having a first base side, a second base side formed contiguous with the first base side, a third base side formed contiguous with the second base side, and a base thickness that is equal to or greater than the neck thickness;

wherein the base extends contiguously from the second neck end.

4. The fluid applicator of claim 3 having a length axis collinear with the base first side;

wherein the tine gap is formed along a tine gap axis extending from the first neck end through a point that is between and equidistant from each tine free end; and wherein the tine gap axis is oriented approximately 45 degrees from the length axis.

5. The fluid applicator of claim 3, wherein the base thickness is greater than the neck thickness and greater than the tine thickness.

6. The fluid applicator of claim 3, wherein the base thickness is greater than the tine thickness and the neck thickness is greater than the tine thickness.

7. The fluid applicator of claim 1, wherein each tine has a quadrilateral cross-section along a majority of its length.

8. The fluid applicator of claim 1, wherein the tine thickness comprises 0.003 inch to 0.010 inch.

9. The fluid applicator of claim 8, wherein the tine thickness comprises 0.005 inch.

* * * * *